US005875615A

United States Patent [19]

Ito et al.

[11] Patent Number: 5,875,615

[45] Date of Patent: Mar. 2, 1999

[54] METHOD OF MANUFACTURING AN INK CARTRIDGE FOR USE IN INK JET RECORDER

[75] Inventors: Kazunori Ito; Seiichi Takada; Masahide Matsuyama; Yuichi Nakamura; Masakazu Sato; Tadatoshi Honzawa; Hisashi Koike; Taeko Nishimura; Masahiko Fukazawa; Kazuo Yamada; Shinichi Yanagisawa; Morio Sato; Kiyoshi Kitahara; Takashi Hara; Takao Kobayashi, all of Nagano, Japan

[73] Assignee: Seiko Epson Corporation, Tokyo, Japan

[21] Appl. No.: 969,862

[22] Filed: Nov. 14, 1997

[30] Foreign Application Priority Data

Nov. 14, 1996 [JP] Japan ..... 8-318696

[51] Int. Cl.[6] ..... B65B 35/54

[52] U.S. Cl. ..... 53/474; 53/428; 53/432; 53/434; 53/438; 53/445; 53/449; 53/471; 141/2; 347/86

[58] Field of Search ..... 141/2; 347/85, 347/86, 87; 53/155, 173, 239, 529, 510, 512, 428, 438, 432, 434, 445, 449, 471, 474

[56] References Cited

U.S. PATENT DOCUMENTS 5,280,299 1/1994 Saikawa et al. .
5,400,573 3/1995 Crystal et al. .
5,477,963 12/1995 Mochizuki et al. .
5,479,968 1/1996 Sanchez et al. .
5,495,877 3/1996 Schwenk et al. .
5,619,238 4/1997 Higuma et al. .
5,621,446 4/1997 Tanaka et al. .
5,732,751 3/1998 Schmidt et al. .
5,734,400 3/1998 Brunetti et al. .
5,790,157 8/1998 Higuma et al. .

*Primary Examiner*—Daniel B. Moon
*Attorney, Agent, or Firm*—Stroock & Stroock & Lavan LLP

[57] ABSTRACT

A method of manufacturing an ink cartridge for use in an ink jet recorder including positioning a container body having a bottom wall and an opening on a pallet such that the bottom wall faces upward, the container body including a porous member, a foam chamber for accommodating the porous member therein, and an ink supply port, having an inlet formed in the bottom surface of the foam chamber and an outlet; inserting packing into the ink supply port; sealing the ink supply port outlet; resetting the container body on the pallet by turning the container body upside down such that the opening faces upward; affixing a filter to the ink supply port inlet; inserting the porous member into the foam chamber; bonding a cover to the opening of the container body; injecting ink into the foam chamber; and sealing the cover.

13 Claims, 14 Drawing Sheets

METHOD OF MANUFACTURING AN INK CARTRIDGE FOR USE IN INK JET RECORDER

BACKGROUND OF THE INVENTION

1. Field of the Invention

The invention relates to a method for manufacturing an ink cartridge for use in an ink jet recorder. More specifically, the present invention relates to a method of manufacturing an ink cartridge for use in an ink jet recorder that has a carriage equipped with an ink jet recording head and a replaceable ink cartridge.

2. Related Art

A conventional ink jet printer includes an ink container carried by a carriage equipped with an ink jet recording head. Ink droplets are produced by pressurizing the ink within a pressure generation chamber located within the ink container. However, when the carriage is pivoted, shaken or caused to travel during printing, the movement can cause the ink to become frothy or foamy. This, in turn, may result in a change in head pressure or cause print failures. Specifically, if ink contains gas bubbles, the pressure at which the ink is under drops, thereby decreasing the ability to squirt ink droplets. For this reason, dissolved air must be eliminated from the ink.

One ink jet printer construction that has attempted to solve this problem is described in European Patent Publication No. 581531, the contents of which are incorporated herein by reference. In that reference, the disclosed ink container of the ink cartridge is partitioned into two subdivisions. A porous material is housed in the subdivision located close to the recording head, and ink is stored in the second subdivision. With such a construction, ink is fed to the recording head via the porous material, which filters the dissolved air from the ink, thereby reducing printing failures.

To manufacture a container body with a porous material, one can seal the container body with a cover; fill the container with degassed ink, and package the ink container such that the quality of the ink cartridge is maintained during distribution. To these ends, the manufacturing steps become complicated, thereby resulting in a decrease in productivity.

Accordingly, it is desirable to develop a method for manufacturing an ink jet cartridge for use in an ink jet recorder, that overcomes disadvantages and limitations of existing methods. The present invention has been contrived in view of drawbacks in the prior art, and an object of the present invention is to provide a manufacturing method that enables efficient and more simple manufacture of an ink cartridge for use in an ink jet recorder.

SUMMARY OF THE INVENTION

Generally speaking, in accordance with the invention, a method of manufacturing an ink cartridge for use in an ink jet recorder is provided. A container body having a bottom wall and an opening can be positioned on a pallet such that the bottom wall faces upward. The container body can include a porous member, a foam chamber for accommodating the porous member therein, and an ink supply port, having an inlet formed in the bottom surface of the foam chamber and an outlet. Packing can be inserted into the ink supply port. The ink supply port outlet can be sealed and the container body reset on the pallet by turning the container body upside down such that the opening faces upward. A filter can then be affixed to the ink supply port inlet, and the porous member inserted into the foam chamber. A cover can then be bonded the opening of the container body, ink injected into the foam chamber, and the cover sealed. By maintaining the container body on the pallet during some or all of these steps, movement of the container to various stations of an assembly line (or procedure) can be efficiently achieved.

Accordingly, it is an object of the invention to provide an efficient method of manufacturing an ink cartridge for use in an ink jet recorder.

Still other objects and advantages of the invention will in part be obvious and will in part be apparent from the specification.

The invention accordingly comprises the several steps and the relation of one or more of such steps with respect to each of the others thereof, which will be exemplified in the method hereinafter disclosed, and the scope of the invention will be indicated in the claims.

BRIEF DESCRIPTION OF THE DRAWINGS

For a fuller understanding of the invention, reference is made to the following description taken in connection with the accompanying drawings in which.

DESCRIPTION OF THE PREFERRED EMBODIMENTS

Figure 1:
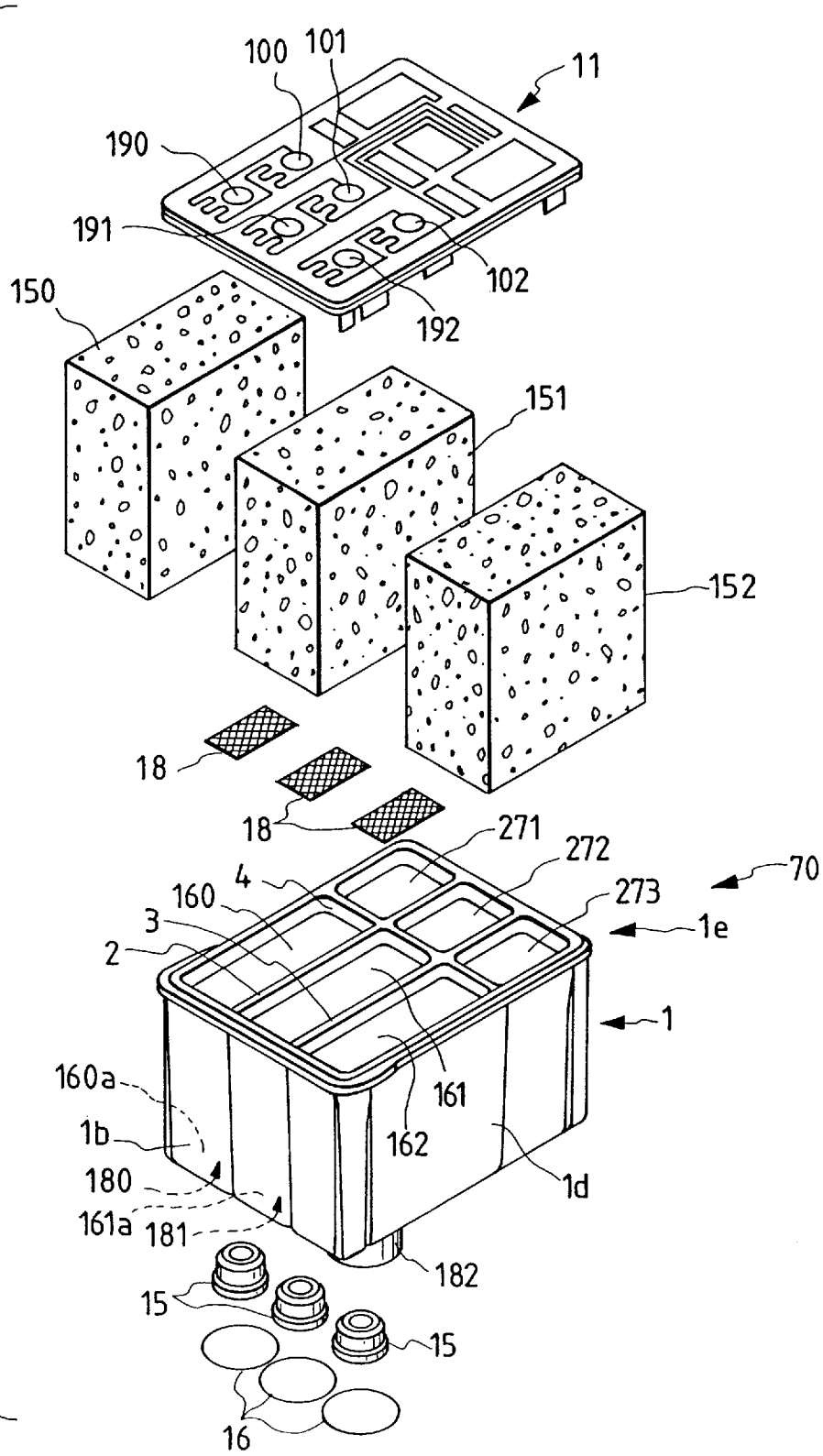
FIG. 1 is a perspective exploded view of an ink cartridge manufactured by a method of the present invention.

Reference is made to FIG. 1, which shows an ink cartridge 70 manufactured by a method in accordance with an embodiment of the present invention. Ink cartridge 70 includes a substantially rectangular container body 1, for preferably containing three colors of ink-cyan, magenta and yellow. Container body 1 is preferably formed from polymeric material, such as polypropylene, polyethylene, or polystyrene by injection molding to facilitate heat welding of other members to the container body.

Container body 1 includes a bottom wall 1*a*, a front wall 1*b* and a back wall 1*c* extending upwardly from bottom wall 1*a*, and two side walls 1*d* extending upwardly from bottom wall 1*a* and positioned between front wall 1*b* and back wall 1*c*. The distance from front wall 1*b* to back wall 1*c* and between side walls 1*d* gradually increases as walls 1*b*, 1*c*, 1*d* extend from bottom wall 1*a* to an opening 1*e* of container body 1 such that the area of opening 1*e* is larger than the area of bottom wall 1*a*.

Container body 1 is divided by partitions 2, 3 and 4 to define ink chambers 271, 272, 273 for storing ink and foam chambers 160, 161, 162 for receiving porous bodies. Each foam chamber 160, 161, 162 is designed to accommodate a respective porous body 150, 151, 152 made of a resilient material suitable for absorbing ink. Each ink chamber 271, 272, 273 is designed to contain liquid ink 67. The volumes of the porous bodies 150, 151, 152 are larger than the capacity of the respective foam chambers 160, 161, 162, so that, upon insertion into foam chamber 160, 161, 162, each of the porous bodies 150, 151, 152 is accommodated in a compressed condition.

Ink is filled in foam chambers 160, 161, 162. During the ink filling operation, each ink is introduced through an ink communication hole 300 to ink chambers 271, 272 and 273. During use of the printer, ink contained in the ink chambers 271, 272, 273 is discharged out first. After the ink chambers 271, 272, 273 are depleted, then ink contained in the foam chambers 160, 161, 162 is consumed.

Container body 1 also includes a plurality of ink feed parts 180, 181 and 182. Ink feed ports 180, 181, 182 are shaped to receive an ink supply needle of a recording head (not shown), and are formed in bottom walls 160*a*, 161*a*, 162*a* of respective foam chambers 160, 161, 162.

An opening 1*e* of container body 1 is sealed with a cover 11 that has exhausting ports 190, 191, 192 and ink injection ports 100, 101, 102 at positions above ink feed ports 180, 181, 182 of foam chambers 160, 161, 162. Like container body 1, cover 11 is preferably formed of polypropylene, polyethylene, or polystyrene to facilitate heat welding.

Figure 4A:
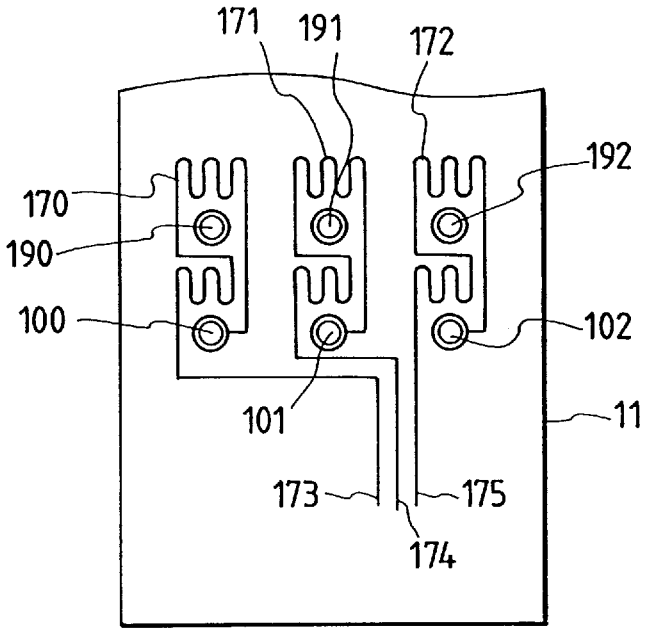
FIG. 4A is a schematic representation showing the plan view of a cover of the ink cartridge of FIG. 1 without a seal.
Figure 4B:
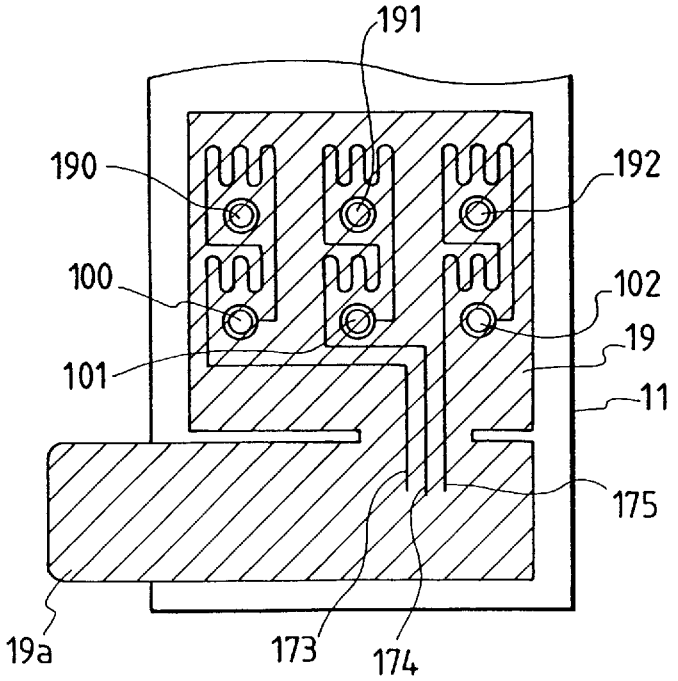
FIG. 4B is a schematic representation showing the showing the plan view of the cover of FIG. 4A with a seal.

Referring to FIGS. 4A and 4B, a plan view of cover 11 is shown, wherein grooves 170, 171, 172 are formed in cover 11 so as to meander across the surface of cover 11. Grooves 170, 171, 172 are connected at one end to respective exhaust ports 190, 191, 192 and at the other end to the air communication ports 173, 174, 175 formed at the inner surface of cover 11.

A seal 19 is secured to the surface of cover 11 so as to seal ink injection ports 100, 101, 102, exhaust ports 190, 191, 192, and grooves 170, 171, 172 from ambient air. Seal 19 includes a tongue 19*a*, which extends beyond cover 11, and is constructed to be easily grasped by a user. When tongue 19*a* is lifted, the seal between seal 19 and cover 11 is broken, and ambient air is provided to the interior of foam chambers 160, 161, 162, through exhaust ports 190, 191, 192, grooves 170, 171, 172, and air communication ports 173, 174, 175.

Figure 2:
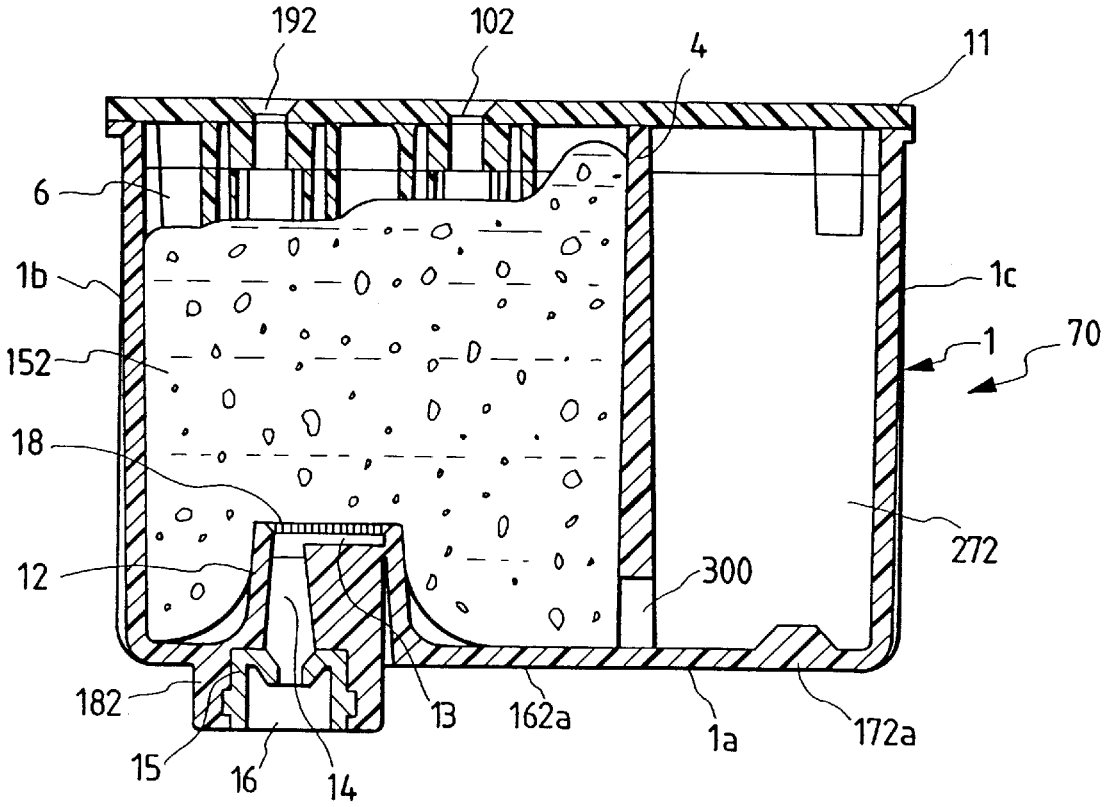
FIG. 2 is a side cross-sectional view of the ink cartridge depicted in FIG. 1.
Figure 3:
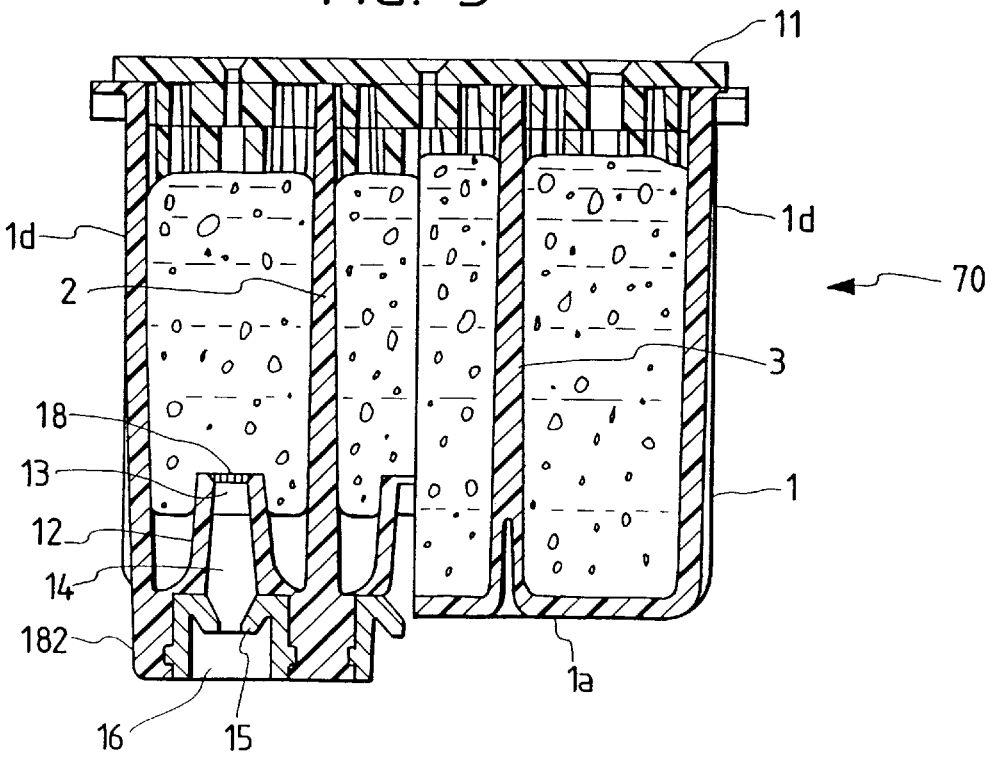
FIG. 3 is a front cross-sectional view of the ink cartridge depicted in FIG. 1.

As is shown in FIGS. 2 and 3, a protuberance 12 extends upwardly from the bottom of each foam chamber 160, 161, 162, and acts to compress porous bodies 150, 151, 152 in cooperation with cover 11. A recess 13 is formed in the upper end of each protuberance 12 so as to constitute a vacancy having an area, and a communication path 14 is formed through each protuberance 12 so as to extend to ink feed ports 180, 181, 182. A packing member 15 is inserted into communication path 14 such that packing member 15 forms a fluid-tight fit with the ink supply needle (not shown) of the recording head when the ink supply needle is inserted into communication path 14. A seal 16, preferably formed from a gas-impermeable material appropriate for heat-welding applications, is secured to the front end of ink feed ports 180, 181, 182, and is capable of being breached by ink supply needle prior to printing.

Figure 5:
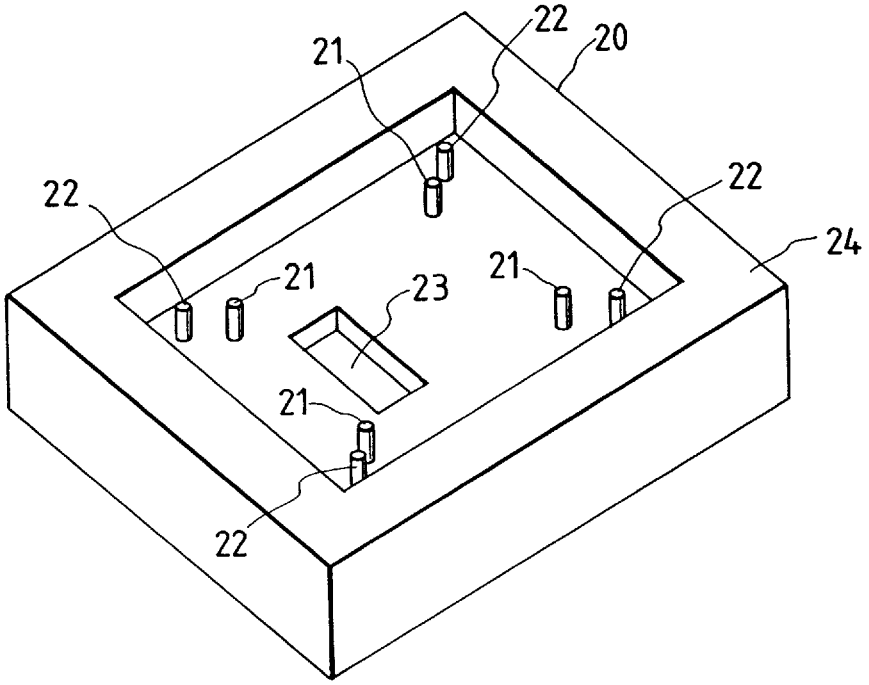
FIG. 5 is a perspective view showing a pallet for retaining and transporting a container body for use in the method in accordance with an embodiment of the present invention.

A method of manufacturing ink cartridge 70 will now be described. FIG. 5 shows one embodiment of a pallet 20 formed in accordance with one embodiment of the invention, having a surface 20*a*, sized, spaced and positioned for transporting container body 1 during the course of the manufacture process. At least four pins 21 extend upwardly from pallet surface 20*a* sized, spaced and positioned for receiving the outer periphery of the surface of bottom wall 1*a* of container body 1. At least four pins 22 extend upwardly from pallet surface 20*a* sized, spaced and positioned for receiving an inner surface 1*f* of opening 1*e* of container body 1. An indentation 23 is formed in an area of pallet 20 corresponding to ink feed ports 180, 181, 182, and a raised section 24 is formed along the edges of pallet 20 to form a sealing section during an ink filling step (described later). Pallet 20 is advantageously used to transport body 1 to various assembly stations during an assembly procedure, such as one employing an automated assembly line.

The pallet 20 may be formed of SUS, steel subjected with Ni plating, steel subjected with Cr plating or plastic such as polycarbonate, deformable PPO and POM and the like. The material of the pallet 20 can be selected from these materials desirably.

Figure 6A:
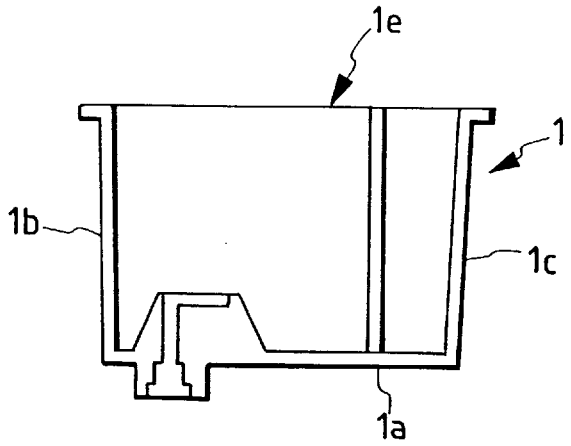
FIGS. 6A, 6B and 6C are diagrammatic representations showing initial steps of an ink cartridge manufacturing method of an embodiment of the present invention.
Figure 6B:
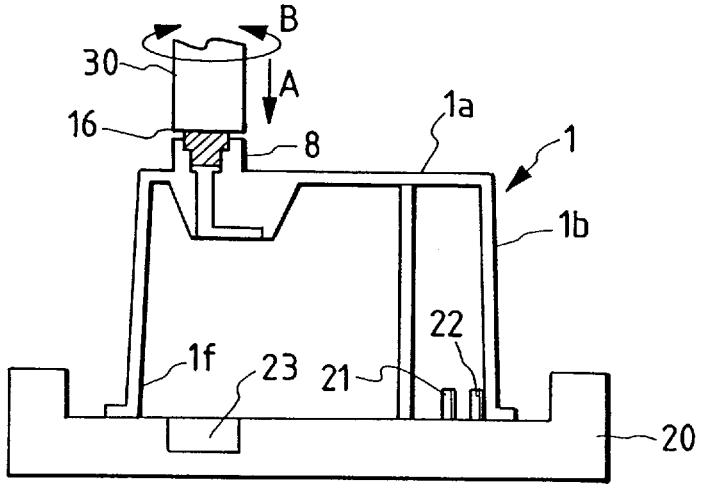

Referring to FIGS. 6A and 6B, container body 1 is positioned and set on pallet 20 by seating container body in an upside-down position where bottom wall 1*a* of container body 1 faces upward and opening 1*e* faces pallet surface 20*a* , and inner surface 1*f* of container body 1 is positioned adjacent to pins 22, which hold body 1 to pallet 20. Next, as is shown in FIG. 6B, packing member 15 is temporarily pressed into ink feed port 180, 181, 182 by a pressing jig 36 in a direction indicated by an arrow A and is further pressed in the direction A into a predetermined position while, at the same time, to reduce friction, pressing jig 30 rotates about the center axis of jig 30 in a direction shown by an arrow B. By pressing packing member 15 while also torquing packing member 15, packing member 15 is fitted into ink inlet port 8 without curling or distorting the peripheral edge of ink feed port 180, 181, 182. Further, by press fitting packing member 15, packing member 15 is reliably prevented from disengaging from ink feed port 180, 181, 182 after foam chambers 160, 161, 162 have been filled with ink.

Figure 6C:
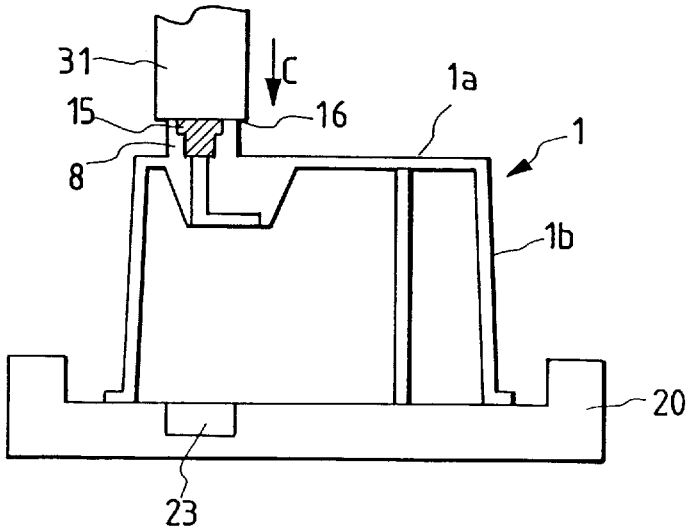

Referring to FIG. 6C, a gas-insulating seal 16 is positioned to cover each ink feed port 180, 181, 182, and the surrounding area of ink feed ports 180, 181, 182 is then heated under pressure with a jig 31. In this way, ink feed ports 180, 181, 182 are sealed with seal 16. At this stage of manufacturing, a lot number or an expiration date can be inscribed on bottom wall 1*a* or side wall 1*d*, or otherwise, as required.

Figure 7:
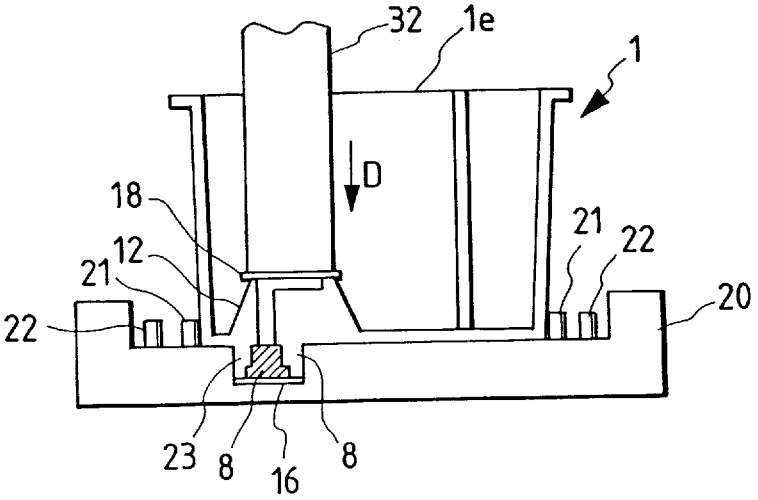
FIG. 7 is a diagrammatic representation showing a step of attaching a filter to a ink supply port inlet according to an ink cartridge manufacturing method of the present invention.

After the bottom wall 1*a* of container body 1 has finished undergoing the above-described operations, as is shown in FIG. 7, container body 1 is re-positioned on pallet 20 such that opening 1*e* of container body 1 faces upward and bottom wall 1*a* is flush with pallet surface 20*a*. The repositioning can be done manually, robotically or otherwise.

Next, filter 18 is positioned to cover indentation 13 and is preferably heat welded under pressure until container body 1 becomes slightly soft to create a bond between filter 18 and protuberance 12. Filter 18 can be formed by cutting a piece of filtering material, such as a rust-proof steel mesh or non-woven fabric, into a filter having an area slightly larger than the area of indentation 13 formed in protuberance 12.

One way of fitting, filter 18 to protuberance 12 is to press the filtering material into a shape that matches the profile of protuberance 12, e.g., a circular or ovate pattern. However, where filter 18 is formed by weaving rust-proof steel wires, the unraveling of filter 18 can be prevented by cutting filter 18 at an angle with respect to the warp and woof directions of the weave. In this manner, a wire of filter 18 is prevented from extending into the area occupied by packing member 15, where it could be sandwiched between the ink supply needle of the recording head and packing member 15 when ink cartridge 70 is attached to the recording head. If a wire is positioned in that way, the air-tight seal formed between the ink supply needle and ink cartridge 70 could be reduced, and the ink supply needle could become clogged, thereby hindering the supply of ink 67 to the recording head. Thus, preventing the fraying of filter 18 helps ensure a reliable ink supply.

Figure 8:
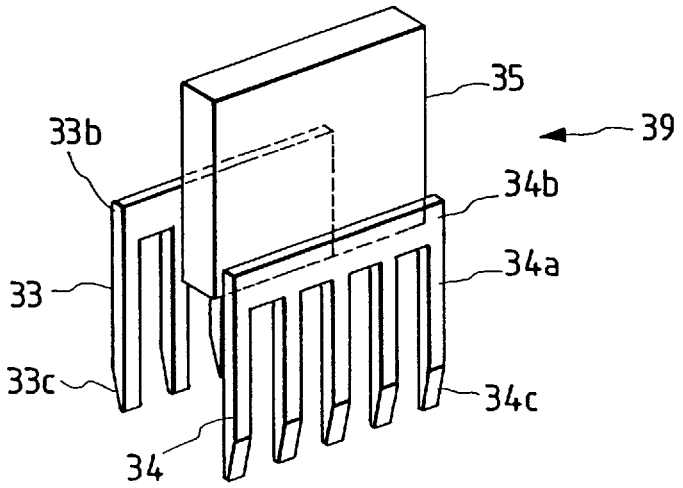
FIG. 8 is a perspective view showing one embodiment of a porous member insertion device used in an ink cartridge manufacturing method of the present invention.
Figure 9A:
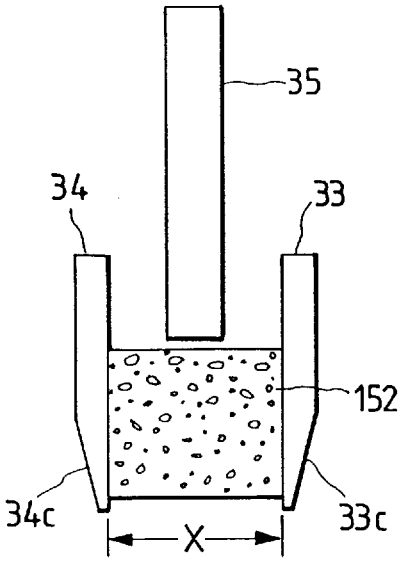
FIGS. 9A, 9B and 9C are diagrammatic representations showing a step of inserting the porous member into the foam chamber of the container body in accordance with an ink cartridge manufacturing method of the present invention.
Figure 9B:
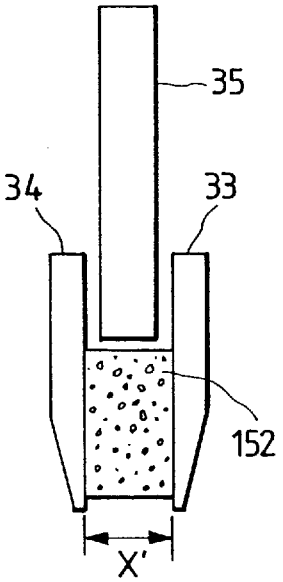
Figure 9C:
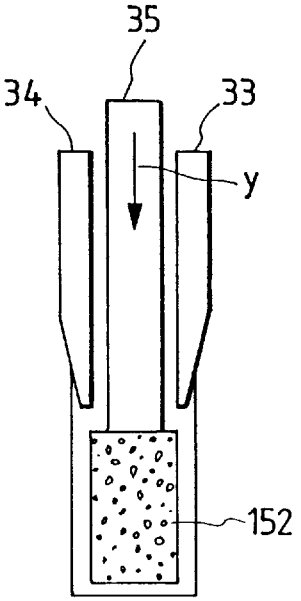

Referring to FIGS. 8 and 9A–9C, the step of press-fitting porous member 152 into each foam chamber (160–162) will now be described. FIG. 8 shows a porous member insertion device 39, in accordance with an embodiment of the invention. FIGS. 9A–9C depict a method for inserting porous member 152 into foam chamber 162. It is understood that the remaining porous members 150 and 151 are similarly pressed into foam chambers 160 and 161, respectively.

As shown in FIG. 8, porous member insertion device 39 comprises compression members 33 and 34, which are comb-shaped, and a press member 35 which is interposed between compression members 33 and 34. Compression members 33 and 34 include bases 33*b*, 34*b* and teeth 33*a*, 34*a*, which extend downwardly from bases 33*b* and 34*b*, respectively. The width between teeth 33*a* and 34*a* in a horizontal direction is shown as a double arrow X in FIG. 9A. Teeth 33*a* and 34*a* taper to free end 33*c* and 34*c*, respectively. Compression members 33 and 34 are moveable in the X direction by an activation means (not shown) to decrease the width to X', as shown in FIG. 9B.

As is shown in FIG. 9A, porous member 152 is sandwiched between compression members 33, 34 by actuation of compression members 33 and 34 toward press member 35 in the X direction until the distance between the outer edges of compression members 33 and 34 is smaller than the inner width of foam chamber 162. As such, porous member 152 is compressed to a size that fits within foam chamber 162.

Figure 10:
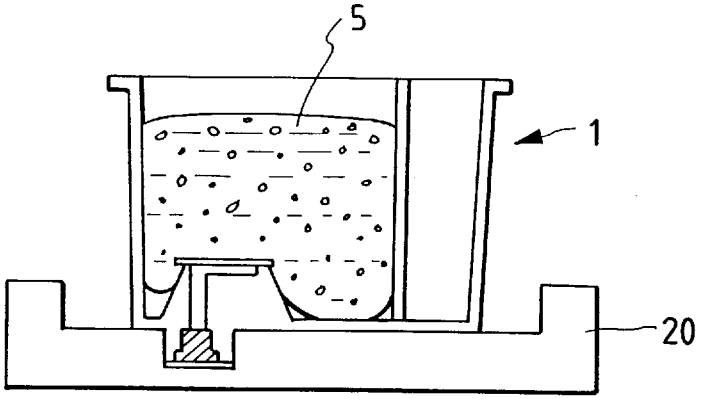
FIGS. 10–12 are diagrammatic representations showing the intermediate steps in accordance with an ink cartridge manufacturing method of the present invention.

At this time, porous member insertion device 39 is positioned over foam chamber 162, such that tapered ends 33*c* and 34*c* of teeth 33*a* and 34*a* fit within foam chamber 162, and press member 35 is actuated by an activating means (not shown) to urge foam chamber 162 in the direction shown as an arrow Y in FIG. 9C. In this way, as depicted in FIG. 9C, porous member 152 is pressed into foam chamber 162. Subsequently, press member 34 is lowered slightly further, and container body 1 is transported away from porous member insertion device 39. As a result, as shown in FIG. 10, porous member 152, which is formed so as to be slightly larger than the volume of foam chamber 162, is set in foam chamber 162 in a compressed state.

Figure 11:
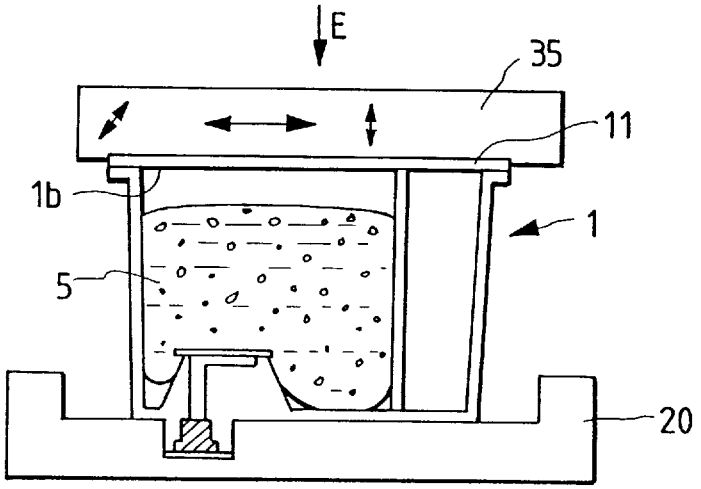

Next, as is shown in FIG. 11, cover 11 is positioned over opening 1*e* of container body 1 and is pressed toward container body 1 by a pressing means at a specified pressure in a direction indicated by arrow E. Further, by way of a jig 35, ultrasound vibrations are applied to cover 11 in the same plane as cover 11, in a direction perpendicular to cover 11, in a direction oblique to cover 11, or in a combination thereof. Thus, opening 1*e* of container body 1 is frictionally fused (ultrasonically welded) to the reverse side of cover 11.

Figure 12:
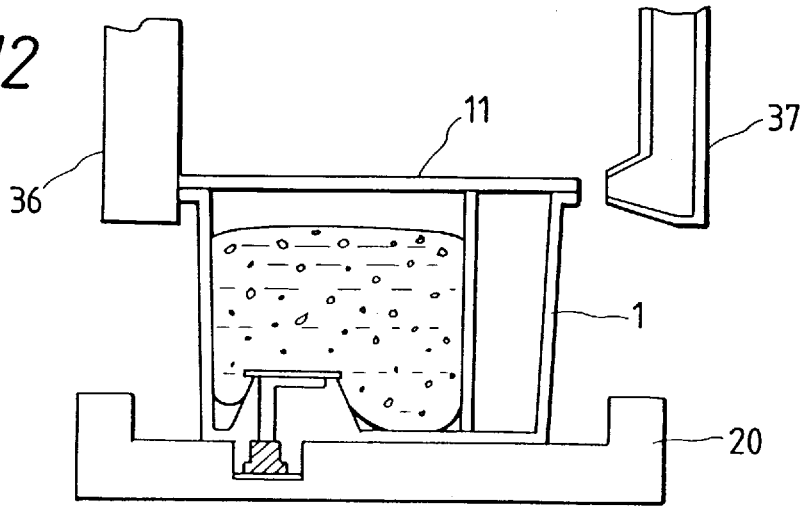
Figure 15:
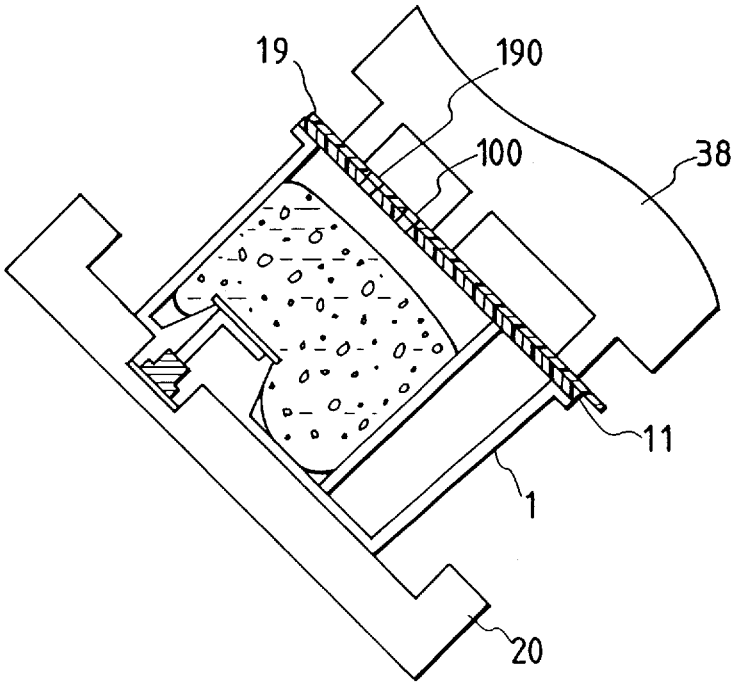
FIG. 15 is a schematic representation showing a step of sealing the cover in accordance with an ink cartridge manufacturing method of the present invention.

Referring to FIG. 12, after cover 11 is fused to container body 1, a heat rod 36, which is heated to a temperature sufficient to soften the material of container body 1 and cover 11, is brought into contact with the periphery of a heating plate or jig 38 shown in FIG. 15, thereby ensuring that heating plate 38 fuse-bonds seal 19 to cover 11. Preferably, hot air is blown from an injection nozzle 37 onto container body 1, so as to eliminate any burrs resulting from the attachment of cover 11 to container body 1.

Figure 13:
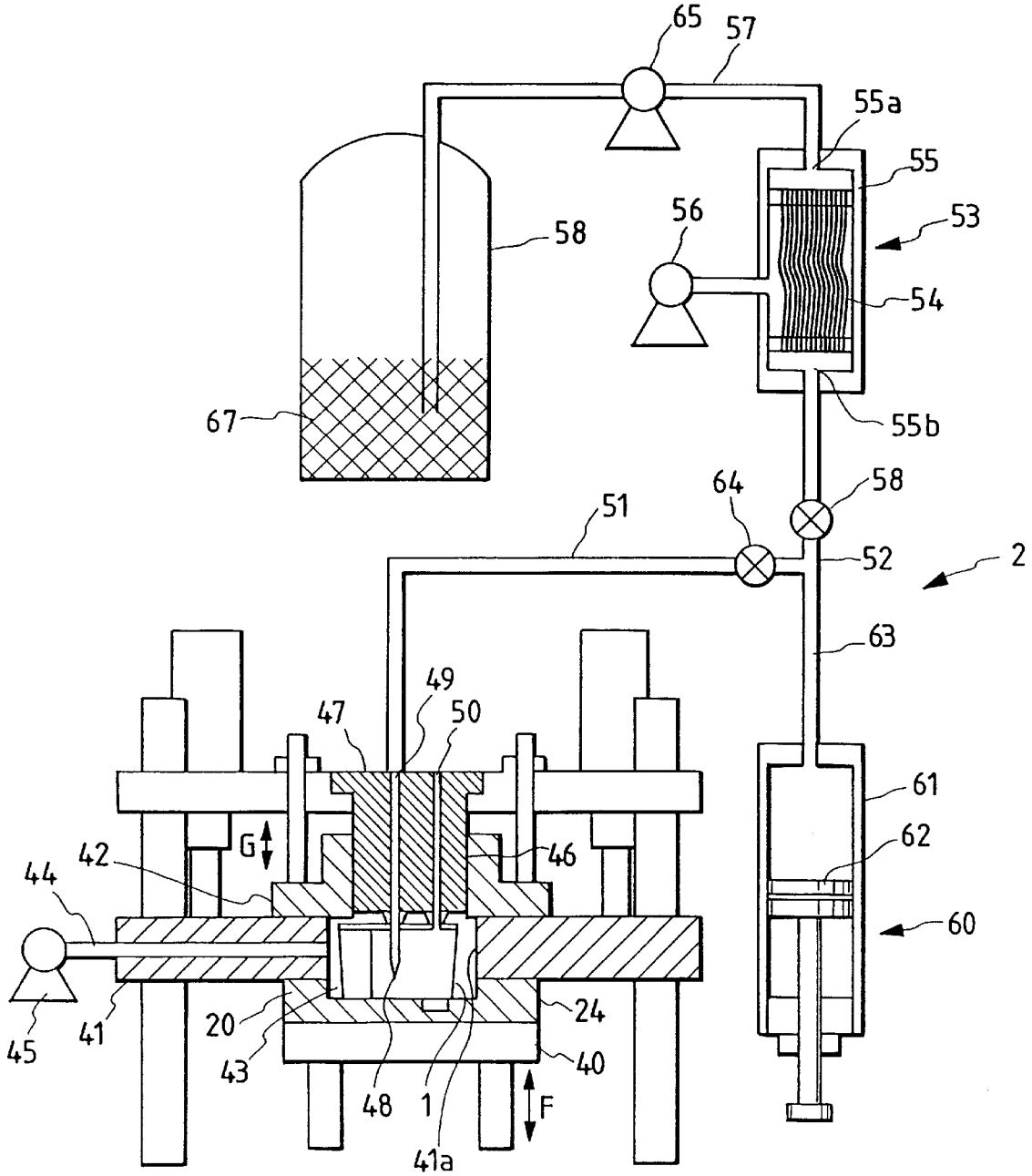
FIG. 13 is a block diagram showing of an ink filling apparatus for use with one embodiment of the ink cartridge manufacturing method of the present invention.

After the assembly of the ink container, the container is transported on pallet 20 to an ink filling station. FIG. 13 shows an ink filling apparatus 200, constructed in accordance with one embodiment of the invention, which includes a table 40 for supporting pallet 20. Table 40 can be vertically actuated in the direction indicated by a double arrow F by means of a drive mechanism (not shown). At this point in the process, container body 1 remains seated in pallet 20 in its upright position. A bed 41, having a through hole 41*a*, formed to accommodate container body 1, is positioned on raised section 24. An injection chamber 43 is formed in through hole 41*a* by the combination of pallet 20, which forms a lower surface of chamber 43, and a cover member 42 which forms an upper surface of chamber 43. Injection chamber 43 is connected to a vacuum pump 45 via a channel 44 formed in bed 41.

A through hole 46 is formed in cover member 42 so as to oppose injection chamber 43. A piston 47 is inserted into through hole 46, and is constructed to maintain injection chamber 43 in an air-tight state while moving vertically in a direction indicated by a double arrow G. Piston 47 includes an injection needle 48, positioned to face ink injection ports 100, 101, 102 of container body 1, set in injection chamber 43, and a channel 50, which faces atmospheric communication ports 190, 191, 192 of container body 1, and is connected to an air supply device (not shown). Injection needle 48 is connected to a branch tube 52 via a channel 49 formed in piston 47, a tube 51, and a stop valve 64.

Ink filling apparatus 200 also includes a gas-liquid separation unit 53. In one preferred embodiment of the invention, gas-liquid separation unit 53 includes a hollow yarn bundle 54, which is preferably connected fluid-tight at both longitudinal ends to a cylinder 55 so as to permit fluid to flow therethrough. Cylinder 55 is connected to a vacuum pump 56 so as to produce negative pressure around the outer periphery of yarn bundle 54. Cylinder 55 includes an inlet 55*a*, which is connected to an ink tank 58 having ink 67 therein, via a tube 57, and an outlet 55*b*, which is connected to branch pipe 52 via a stop valve 58.

Branch pipe 52 is also connected to a measuring tube 60 via a tube 63. Measuring tube 60 includes a cylinder 61 and a piston 62, and is preferably connected to branch pipe 52 at the center of one end of cylinder 61.

Figure 14A:
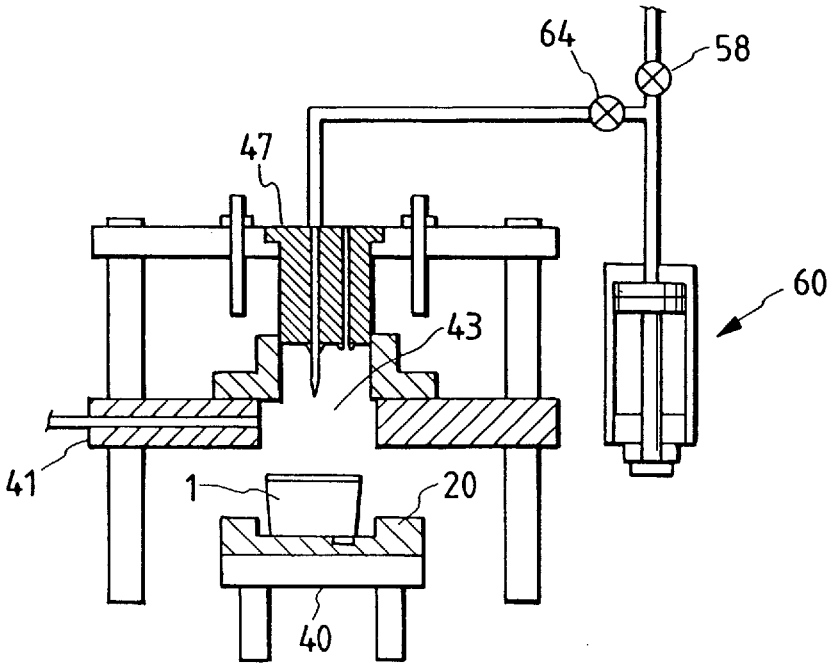
FIGS. 14A to 14E are schematic representations showing a step of the ink injection process in accordance with an ink cartridge manufacturing method of the present invention.
Figure 14B:
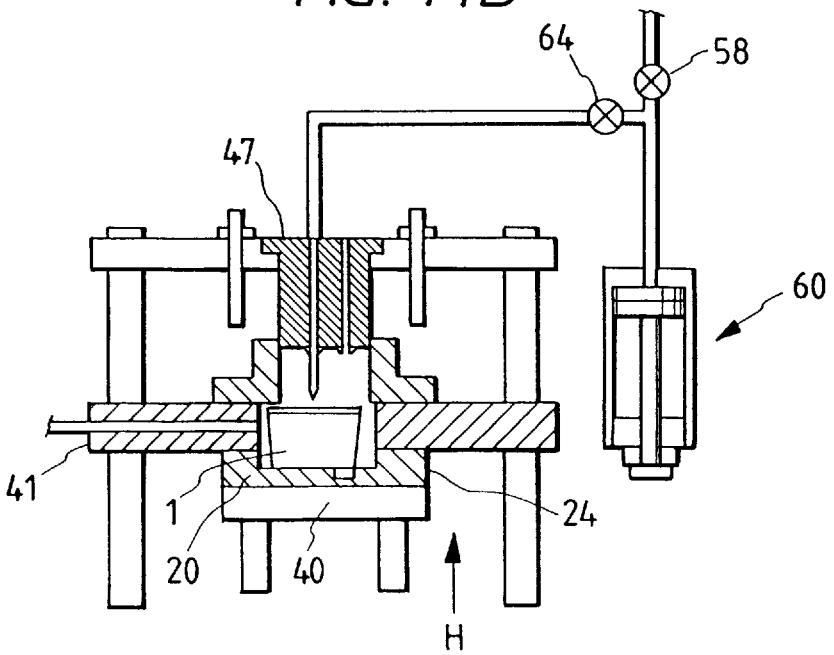

After container body 1 has been assembled, it is transported on pallet 20 to ink injection apparatus 200, and is set below injection chamber 43, as is shown in FIG. 14A. Table 40 is then raised in a direction H until raised portion 24 of pallet 20 comes into close contact with a lower surface of bed 41, as shown in FIG. 14B.

Figure 14C:
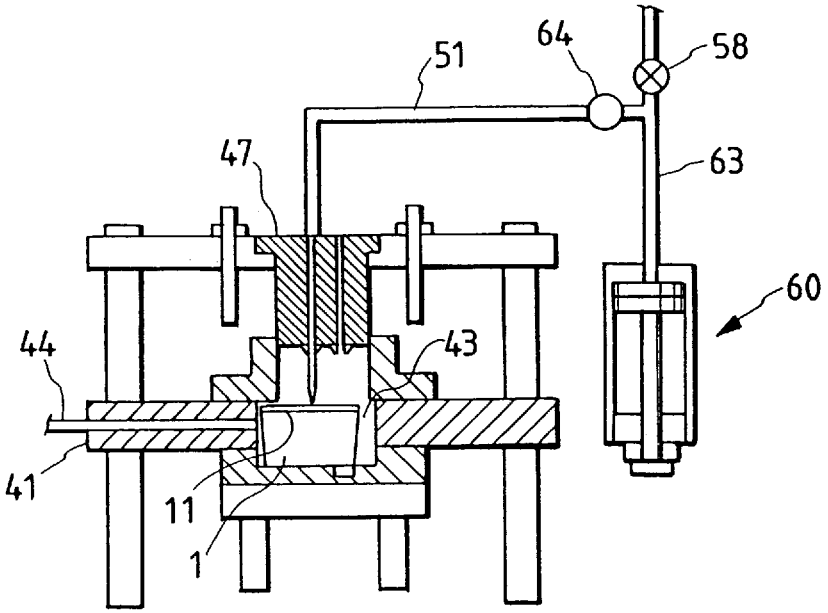

Subsequently, referring to FIG. 14C, piston 47 is lowered such that a gap exists between piston 47 and cover 11 of container body 1 and piston 47 forms a seal with cover member 42. Stop valve 64 is then opened while maintaining stop valve 58 connected to the gas-liquid separation unit 60 in a closed position. Vacuum pump 45, which is connected via channel 44 to injection chamber 43, is then activated to depressurize injection chamber 43, tubes 51 and 63, and measuring tube 60 to a predetermined pressure.

Figure 14D:
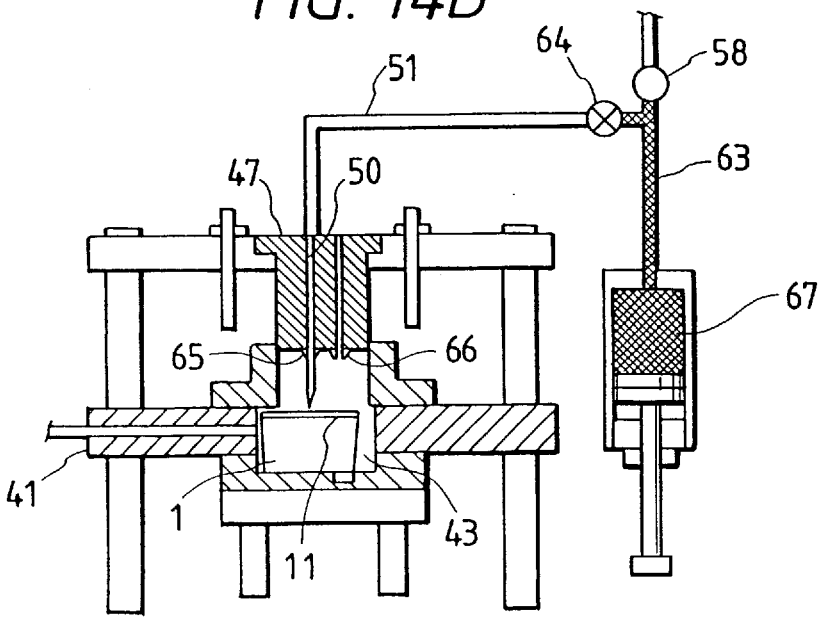
Figure 14E:
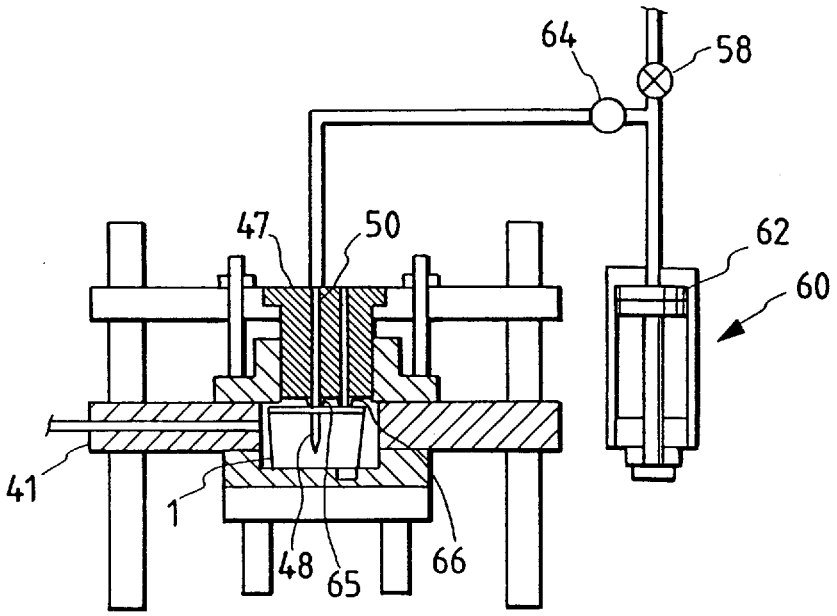

Referring to FIG. 14D, when injection chamber 43 and tubes 51, 60 and 63 have been evacuated to a predetermined pressure, stop valve 64 is closed. Thereafter, measuring tube 60 is placed in fluid communication with gas-liquid separation unit 53 by opening stop valve 58, and a predetermined quantity of ink 67 is filled into measuring tube 60. In conjunction with this operation, as is shown in FIG. 14E, piston member 47 is lowered such that packing members 65, 66 formed on the lower end of piston member 47 are brought into elastic contact with ink injection port 100 and atmospheric port 190 of container body 1, respectively. Further, injection needle 48 is positioned in fluid communication with container body 1, as it is inserted through ink inlet port 100 into the vicinity of the bottom of container body 1. Since gas-liquid separation unit 53 is connected close to measuring tube 60, ink flows into measuring tube 60 immediately after having been degassed by gas-liquid separation unit 53.

Next, as shown in FIG. 14E, stop valve 58 is closed to isolate gas-liquid separation unit 53, stop valve 64 is opened, and piston 62 of measuring tube 60 is pressed to discharge the predetermined quantity of ink 67 into foam chamber 160 via ink injection port 100. At this time, ink 67, which has been completely degassed by gas-liquid separation unit 53, is absorbed into porous member 150. As a result, gas trapped in the pores of porous member 150 that were not discharged in the foregoing depressurization step, readily dissolves into ink 67. Therefore, ink 67 is uniformly absorbed by porous member 150 without causing air bubbles to form in porous member 150. When foam chamber 160 is filled with ink 67, air bubbles do not exist in at least porous members 150, and because air bubbles are not introduced via channel 50, ink 67 provided to the recording head via the porous member 150 is free of bubbles, thereby ensuring print quality. Next, the remaining foam chambers 161, 162 are filled with ink by a similar process.

Upon completing of the ink filling process, channel 50 is opened to ambient air, so that ink 67 that remains on an upper part of porous member 150 is completely absorbed into porous member 150 by means of the pressure differential between the pressure in porous member 150 and ambient pressure. Subsequently, table 40 is lowered, and pallet 20 is transported to the next assembly station. The other porous members can be filled with ink in a similar fashion. The ink that has adhered to ink injection port 100 during the filling process is wiped off by vacuum suction or with a cloth. Finally, a conduit (not shown) is brought into contact with ink injection port 100, and a very small positive suction is applied to the conduit, thereby suctioning the ink adhered to the reverse side of cover 11.

Next, as is shown in FIG. 15, container body 1 is housed in a depressurization container and is inclined in such a way that exhausting ports 190, 191, 192 face upward. Seal 19 is formed so as to cover at least exhaustion ports 190, 191, 192, the ink inlet ports 100, 101, 102 and grooves 170, 171, 172, and can be temporarily adhered to cover 11 by heat welding or otherwise. Prior to sealing cover 11, if there is an increase in the pressure within container body 1 due to an increase in temperature, exhaustion ports 190, 191, 192 are immediately raised to a higher position, and hence the expanded air is immediately discharged from exhaustion ports 190, 191, 192. As a result, ink is prevented from leaking from the ink inlet ports 100, 101, 102.

Next, the area of seal 19 covering grooves 170, 171, 172 is heated, so that a part of seal 19 is welded to the surface of cover 11 thereby forming capillaries. The principle portion of the remainder of seal 19 is adhered to cover 11 such that it can be readily peeled away from cover 11.

Figure 16:
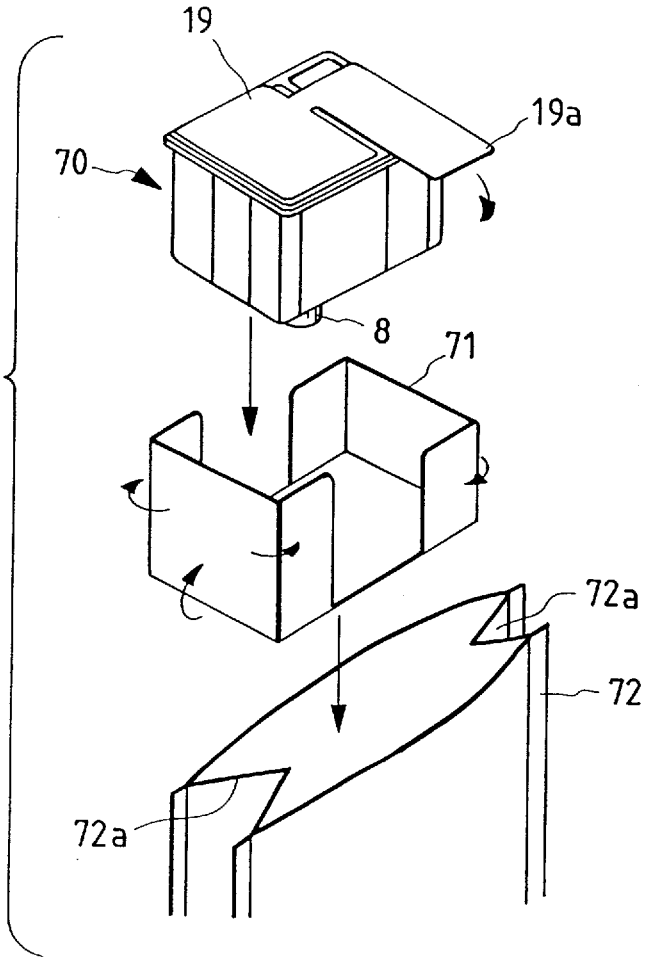
FIG. 16 is an exploded view showing a first step of a packaging process in accordance with an ink cartridge manufacturing method of the present invention.
Figure 17A:
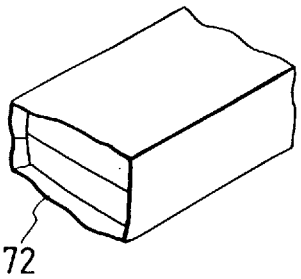
FIGS. 17A and 17B are schematic representations showing final steps of a packaging process in accordance with an ink cartridge manufacturing method of the present invention.
Figure 17B:
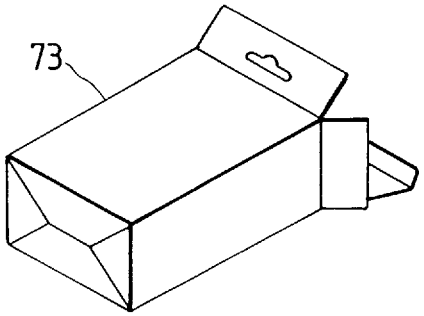

As shown in FIG. 16, in an ink-filled ink cartridge 70, at least ink ejection ports 180, 181, 182 are bought into contact with a buffer 71 so as to prevent seals 16 from rupturing. Further, tongue 19*a* of seal 19 is folded, and ink cartridge 70 is then inserted into a bag 72, which is preferably formed from a gas-insulating film, and has a collar 72*a*. Collar 72*a* is arranged near the opening of bag 72, and is folded inwardly to a uniform thickness. The opening of bag 72 is heat welded in a vacuum environment as shown in FIG. 17A. Finally, the packaged ink cartridge 70 is inserted into a case 73, and is ready to be shipped as a product (FIG. 17B).

Figure 18:
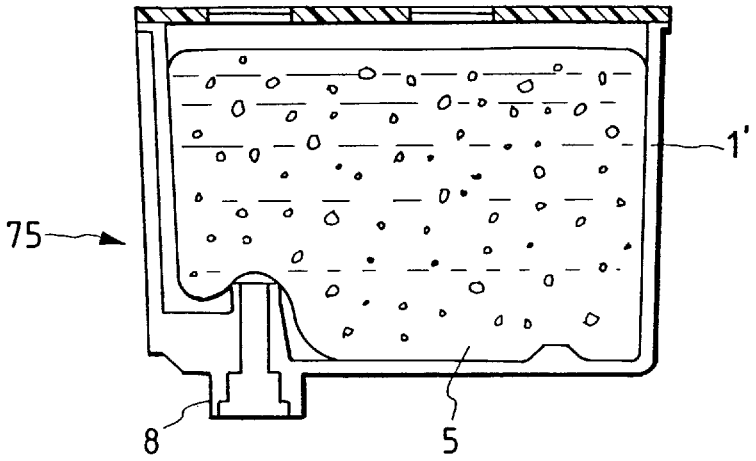
FIG. 18 is a schematic representation showing an ink cartridge manufactured according to a second embodiment of the present invention.

Although the present invention has been described with reference to the cartridge having multiple ink chambers, the present invention can be applied to the manufacture of an ink cartridge 75 such as that shown in FIG. 18, where ink is only filled into porous member 5 housed in container body 1'.

Figure 19:
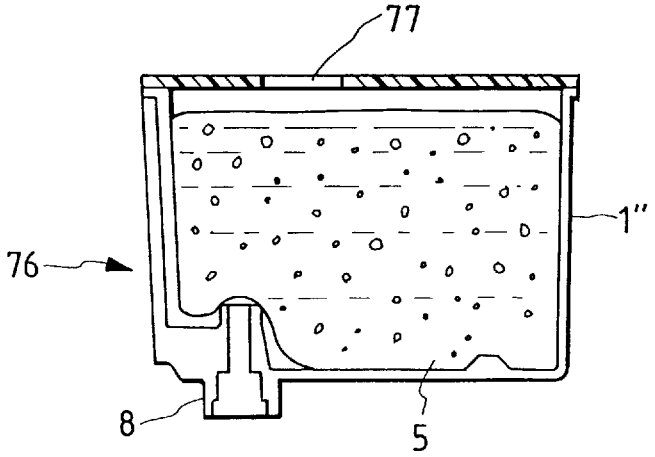
FIG. 19 is a schematic representation showing an ink cartridge manufactured according to a third embodiment of the present invention.
Figure 20:
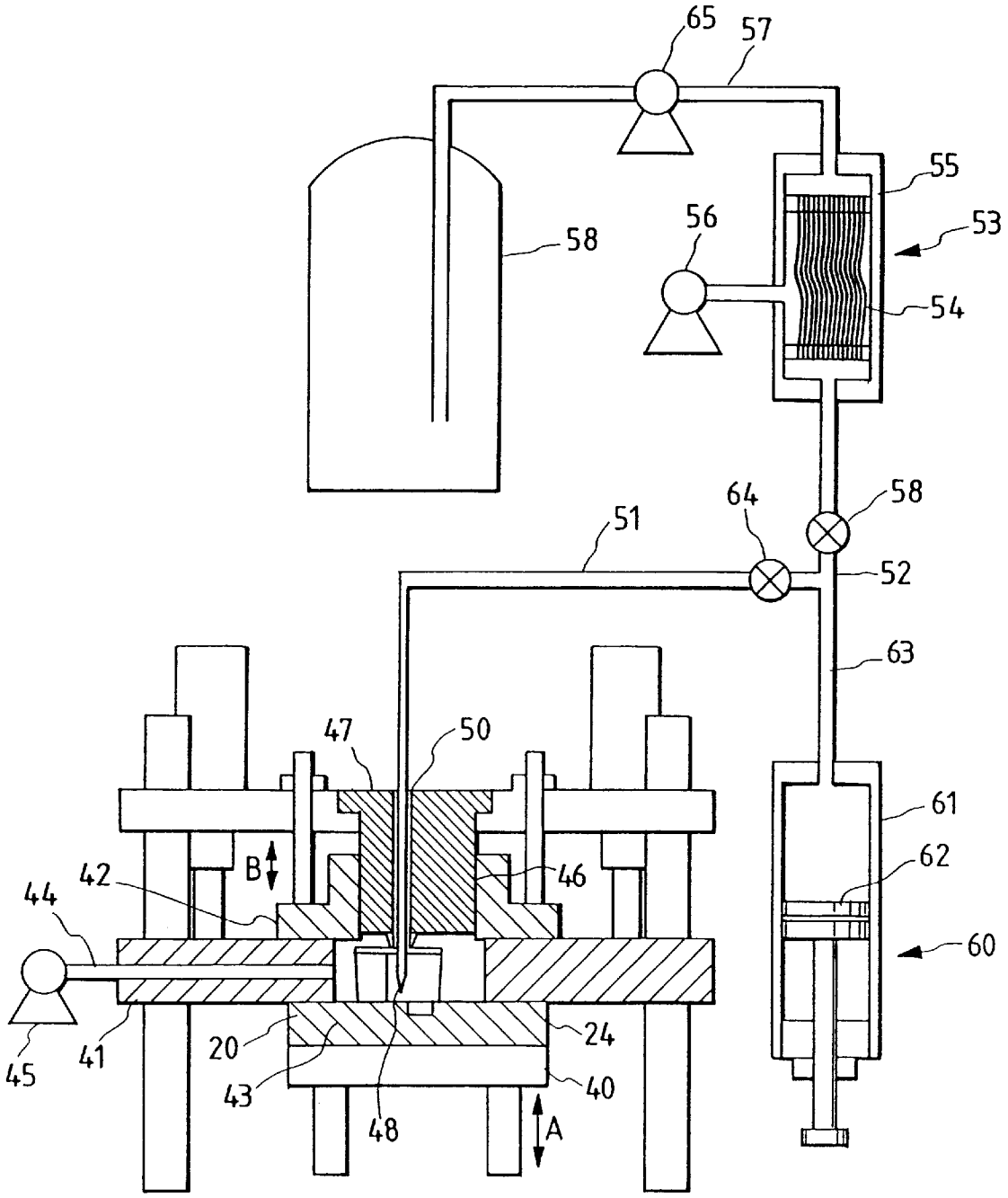
FIG. 20 is a block diagram showing an ink filling apparatus for use with an ink cartridge manufacturing method of a second embodiment of the present invention.

Further, in the case of a small cartridge 76 having a body 1", shown in FIG. 19, only one opening 77 may be formed in a cartridge 76 so as to serve as an ink inlet port and an atmospheric communication port. In such a case, as shown in FIG. 20, ink injection needle 48 and channel 50 connected to the exhaust device (not shown) are provided coaxially with respect to each other. As such, one opening 77 can be used both for ink injection and air exhaust operations.

As has been described above, the present invention provides a method of manufacturing an ink cartridge for use in an ink jet recorder, including the steps of: setting on a pallet a substantially rectangular container body, having an opening, so that the bottom surface of the container body faces upward, the container body including porous members formed from resilient material for absorbing ink, foam chambers for incorporating the porous members therein, and ink ejection ports formed in the bottom surface of the foam chambers; inserting a packing member into each of the ink ejection ports and heat-welding sealing film to the ink ejection port openings; resetting the container body on the pallet by turning it upside down to its upright position;

affixing filter material to the entrance side of the ink ejection port; pressing the compressed porous member into each of the foam chambers; forming the container by bonding a cover to the opening of the container body; filling a specified quantity of ink into each of the foam chambers while the container is held in a vacuum environment; and bonding a seal to the surface of the cover. As a result, the ink cartridge can be efficiently manufactured by transporting the ink cartridge on the pallet at each step of the manufacturing process.

It will thus be seen that the objects set forth above, among those made apparent from the preceding description are efficiently obtained and, since certain changes may be made in carrying out the above method and in the constructions set forth without department from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A method of manufacturing an ink cartridge for use in an ink jet recorder, comprising the steps of:

positioning a container body having a bottom wall and at least one wall defining an opening spaced from the bottom wall, on a pallet, such that the bottom wall faces upward away from the pallet, the container body including a foam chamber for accommodating a porous member therein, and an ink supply port, having an inlet formed in a bottom surface of the foam chamber and an outlet;

inserting packing into the ink supply port and then sealing the ink supply port outlet;

resetting the container body on the pallet by turning the container body upside down such that the opening faces upward;

affixing a filter to the ink supply port inlet;

inserting a porous member into the foam chamber;

bonding a cover to the opening of the container body;

injecting ink into the foam chamber; and sealing the cover.

2. The method of claim 1, wherein the porous member is inserted into the foam chamber while being compressed between compression members and is maintained in the foam chamber in a state of compression.

3. The method of claim 1, wherein the cover is bonded by ultrasonic welding.

4. The method of claim 1, wherein, after bonding the cover to the container body, a bonded area of the container is heated to create a secure bond.

5. The method of claim 1, wherein prior to injecting ink into the foam chamber, the ink is measured by a measuring tube.

6. The method of claim 5, wherein ink is fed to the measuring tube by a gas-liquid separation unit.

7. The method of claim 6, wherein prior to feeding the ink to the measuring tube, the gas contained in the ink is substantially removed.

8. The method of claim 7, wherein the gas is substantially removed with a gas-liquid separation unit that includes a yarn bundle.

9. The method of claim 1, wherein ink is injected into the foam chamber through an ink injection port.

10. The method of claim 9, comprising the step of removing ink adhered near the ink injection port after ink has been injected into the foam chamber, and applying positive pressure to the ink injection port to remove ink from the inner surface of the cover.

11. The method of claim 1, wherein while the cover is being sealed, the container is set in an inclined position, with an ink exhaust port above an ink injection port.

12. The method of claim 1, wherein prior to sealing the cover, an ink injection port is sealed by heat welding.

13. The method of claim 1, comprising the steps of bringing a buffer into contact with at least the ink supply port after the cover is sealed; inserting the container into a bag having an opening and a collar; shaping the collar to a uniform thickness; and sealing the opening of the bag in a vacuum environment.

* * * * *